US011679490B2

(12) United States Patent
Slocum

(10) Patent No.: US 11,679,490 B2
(45) Date of Patent: Jun. 20, 2023

(54) FLOOR JOIST SQUARE

(71) Applicant: Andrew Floyd Slocum, Cambridge (CA)

(72) Inventor: Andrew Floyd Slocum, Cambridge (CA)

( * ) Notice: Subject to any disclaimer, the term of this patent is extended or adjusted under 35 U.S.C. 154(b) by 0 days.

(21) Appl. No.: 17/502,745

(22) Filed: Oct. 15, 2021

(65) Prior Publication Data

US 2023/0121959 A1 Apr. 20, 2023

(51) Int. Cl.
*B25H 7/02* (2006.01)
*E04G 21/18* (2006.01)

(52) U.S. Cl.
CPC ..... *B25H 7/02* (2013.01); *E04G 21/1891* (2013.01)

(58) Field of Classification Search
CPC ..... B25H 7/02; E04G 21/1891
See application file for complete search history.

(56) References Cited

U.S. PATENT DOCUMENTS 2,998,655 A * 9/1961 White ..... G01C 9/24 33/340
3,345,750 A * 10/1967 Hill ..... G01B 3/56 33/342
4,573,276 A * 3/1986 Torczon ..... B25H 7/02 D8/16
4,930,225 A * 6/1990 Phillips ..... E04F 21/0076 33/526
5,388,340 A * 2/1995 Marty ..... E04F 21/26 33/421
5,419,057 A 5/1995 Jackson
5,727,325 A 3/1998 Mussell
5,771,597 A * 6/1998 Hopf ..... G01B 3/566 33/465
6,314,652 B1 * 11/2001 English ..... G01C 9/26 33/421
6,604,296 B2 * 8/2003 Mastrobattista ..... B23Q 9/0042 83/745
6,796,049 B1 * 9/2004 Claxton ..... E04F 21/0092 33/527
6,851,201 B1 * 2/2005 Gioia ..... B43L 7/02 33/492
6,954,990 B2 * 10/2005 Ellis ..... G01B 3/563 33/471
7,174,650 B1 2/2007 Marshall
(Continued)

FOREIGN PATENT DOCUMENTS

CA 2406539 C 9/2002

*Primary Examiner* — Yaritza Guadalupe-McCall
(74) *Attorney, Agent, or Firm* — Stratford Group Ltd.

(57) ABSTRACT

A floor joist square is provided. A floor joist square for facilitating marking a straight-line along a face of an engineered I-shaped floor joist, the floor joist square comprises a blade member, a tongue member, and a handle. The blade member is flat and rectangular in shape and comprising a substantially thin first lip extending out from a first end of the blade member and a substantially thin second lip extending out from a second end of the blade member. The tongue member is flat and rectangular in shape and is perpendicularly affixed to the blade member at an end of the tongue member above the second lip. The handle is affixed to the blade member and the tongue member such that the handle, the blade member, and the tongue member form a triangular shape.

11 Claims, 6 Drawing Sheets

(56) References Cited

U.S. PATENT DOCUMENTS

| | | | | |
|---|---|---|---|---|
| 7,305,773 | B2 * | 12/2007 | Hios | G01C 9/18 33/482 |
| 7,587,833 | B2 * | 9/2009 | Bittner | E04F 21/0015 33/429 |
| 7,913,413 | B2 * | 3/2011 | McHowell | G01B 3/30 33/645 |
| 8,028,434 | B2 * | 10/2011 | McHowell | G01B 3/30 33/645 |
| 8,146,260 | B1 * | 4/2012 | Visser | B43L 13/028 33/418 |
| 8,307,564 | B1 * | 11/2012 | Heaton | G01B 3/566 33/476 |
| 10,759,043 | B2 | 9/2020 | Denton | |
| 2007/0074414 | A1 | 4/2007 | Neuroth | |
| 2007/0245582 | A1 * | 10/2007 | Bittner | G01C 9/24 33/474 |
| 2008/0222908 | A1 * | 9/2008 | Bittner | G01C 15/12 52/741.1 |
| 2010/0139106 | A1 | 6/2010 | Atwood | |
| 2013/0227846 | A1 | 9/2013 | Buzzed | |
| 2019/0150290 | A1 * | 5/2019 | Jara Rodelgo | B33Y 80/00 33/562 |
| 2020/0047542 | A1 | 2/2020 | Walsh et al. | |

* cited by examiner

FLOOR JOIST SQUARE

FIELD OF THE INVENTION

The present disclosure relates to a floor joist square, more specifically, but not by way of limitation, more particularly to a marking tool for facilitating marking a straight line along the face of an engineered I-shaped floor joist.

BACKGROUND

Any discussion of the related art throughout the specification should in no way be considered as an admission that such related art is widely known or forms part of common general knowledge in the field.

In the last 5 years alone, the use of engineered I-shaped floor joists has become the standard amongst builders and carpenters. In order for builders and carpenters to modify the engineered I-shaped floor joists for custom builds, they must ensure a straight cut along the flanges and web of the engineered I-shaped floor joists. Since the flanges are raised above the web, marking for the cuts is required in multiple planes, which reduces the precision of marking and ease of use when using modern marking squares resulting in diminished productivity.

CA Pub. No. 2,406,539 C (Doyle) discloses an extendable square for marking along a flat plane. Shortcomings include an inability to accommodate straight marking along multiple planes of an engineered I-shaped floor joist with a single stroke.

U.S. Pub. No. 2007/0074414 A1 (Neuroth) discloses a combination speed square with an integral measuring device. Shortcomings include an inability to accommodate straight marking along multiple planes of an engineered I-shaped floor joist with a single stroke.

U.S. Pub. No. 2010/0139106 A1 (Atwood) discloses a hinged measuring and marking device. Shortcomings include an inability to accommodate straight marking along multiple planes of an engineered I-shaped floor joist with a single stroke.

U.S. Pub. No. 2013/0227846 A1 (Buzzell) discloses a rafter angle square. Shortcomings include an inability to accommodate straight marking along multiple planes of an engineered I-shaped floor joist with a single stroke.

U.S. Pub. No. 2020/0047542 A1 (Walsh et al.) discloses an extendible speed square. Shortcomings include an inability to accommodate straight marking along multiple planes of an engineered I-shaped floor joist with a single stroke, the additional time required to set up the adjustment mechanism, the required maintenance of the adjustment mechanism, and the potential for the adjustment mechanism to jam or break over time.

U.S. Pat. No. 5,419,057 A (Jackson) discloses a floor joist square. Shortcomings include an inability to accommodate straight marking along multiple planes of an engineered I-shaped floor joist with a single stroke.

U.S. Pat. No. 5,727,325 A (Mussell) discloses a multipurpose square. Shortcomings include an inability to accommodate straight marking along multiple planes of an engineered I-shaped floor joist with a single stroke.

U.S. Pat. No. 7,174,650 B1 (Marshall) discloses an adjustable and extendable sliding ruler square. Shortcomings include an inability to accommodate straight marking along multiple planes of an engineered I-shaped floor joist with a single stroke, the additional time required to setup the adjustment mechanism, the required maintenance of the adjustment mechanism, and the potential for the adjustment mechanism to jam or break over time.

U.S. Pat. No. 8,307,564 B1 (Heaton) discloses a deck-building assist tool. Shortcomings include an inability to accommodate straight marking along multiple planes of an engineered I-shaped floor joist with a single stroke.

U.S. Pat. No. 10,759,043 B2 (Denton) discloses an adjustable square for marking cut lines on wooden I-beams having parallel flanges with a connect web disposed therebetween. Shortcomings include the additional time required to setup the adjustment mechanism, the required maintenance of the adjustment mechanism and the potential for the adjustment mechanism to jam or break over time.

All documents cited herein are incorporated by reference.

It is clear that there exists a need for a floor joist square for facilitating marking a straight line along the face of an engineered I-shaped floor joist. There is a need for a floor joist square that accommodates straight marking along multiple planes of an engineered I-shaped floor joist, that may be applied with ease and marked with a single stroke and has no adjustment mechanism or any additional unnecessary parts that may prone to wear, break or require maintenance.

BRIEF SUMMARY

It is an object of the invention to provide a floor joist square.

In accordance with an aspect of the invention, there is provided A floor joist square for facilitating marking a straight-line along a face of an engineered I-shaped floor joist. The floor joist square comprises a blade member, a tongue member and a handle. The blade member is flat and rectangular in shape and comprises a substantially thin first lip extending out from a first end of the blade member and a substantially thin second lip extending out from a second end of the blade member. The tongue member is flat and rectangular in shape and is perpendicularly affixed to the blade member at an end of the tongue member above the second lip. The handle is affixed to the blade member and the tongue member such that the handle, the blade member, and the tongue member form a triangular shape.

In accordance with another aspect of the invention, there is provided a method of applying the floor joist square for marking the engineered I-shaped floor joist in preparation for cutting, the method comprising inserting the floor joist square onto the engineered I-shaped floor joist such that the tongue member lies flat against a second flange of the engineered I-shaped floor joist, the blade member lies flat against a web of the engineered I-shaped floor joist, the first lip lies flat on top of a first flange of the engineered I-shaped floor joist and the second lip lies flat on top of the second flange of the engineered I-shaped floor joist. Holding the floor joist square in place and marking the second flange along an edge of the second lip, the web along an edge of the blade member and the first flange along an edge of the first lip in one continuous motion.

In accordance with an embodiment of the invention, the blade member further comprises a plurality of hatch marks along a surface of the blade member designating increments of spatial distance for measurement.

In accordance with an embodiment of the invention, the tongue member further comprises a plurality of hatch marks along a surface of the tongue member designating increments of spatial distance for measurement.

In accordance with an embodiment of the invention, the floor joist square is fabricated via a 3D printer.

In accordance with an embodiment of the invention, the 3D printed floor joist square is of unitary construction.

In accordance with an embodiment of the invention, the blade member, the tongue member, and the handle are 3D printed individually and assembled into the floor joist square.

In accordance with an embodiment of the invention, a thickness of said blade member and a thickness of the tongue member are equivalent to a recessed thickness of a web from a top of a first flange of the engineered I-shaped floor joist and a second flange of the engineered I-shaped floor joist.

In accordance with an embodiment of the invention, the floor joist square is inserted onto the engineered I-shaped floor joist by gripping the handle and maneuvering the floor joist into place.

In accordance with an embodiment of the invention, the floor joist square is held in place by gripping the handle.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

In the figures, embodiments are illustrated by way of example. It is to be expressly understood that the description and figures are only for the purpose of illustration and as an aid to understanding.

Figure 1:
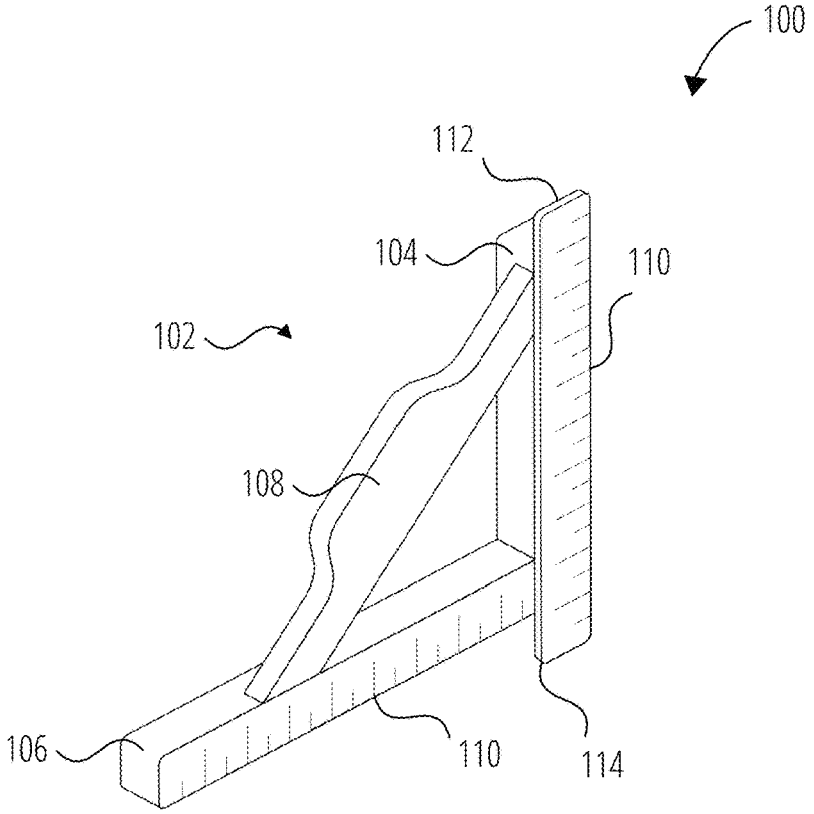

Embodiments will now be described, by way of example only, with reference to the attached figures, wherein the figures:

FIG. 1 illustrates a perspective view of a floor joist square, in accordance with one embodiment.

Figure 2:
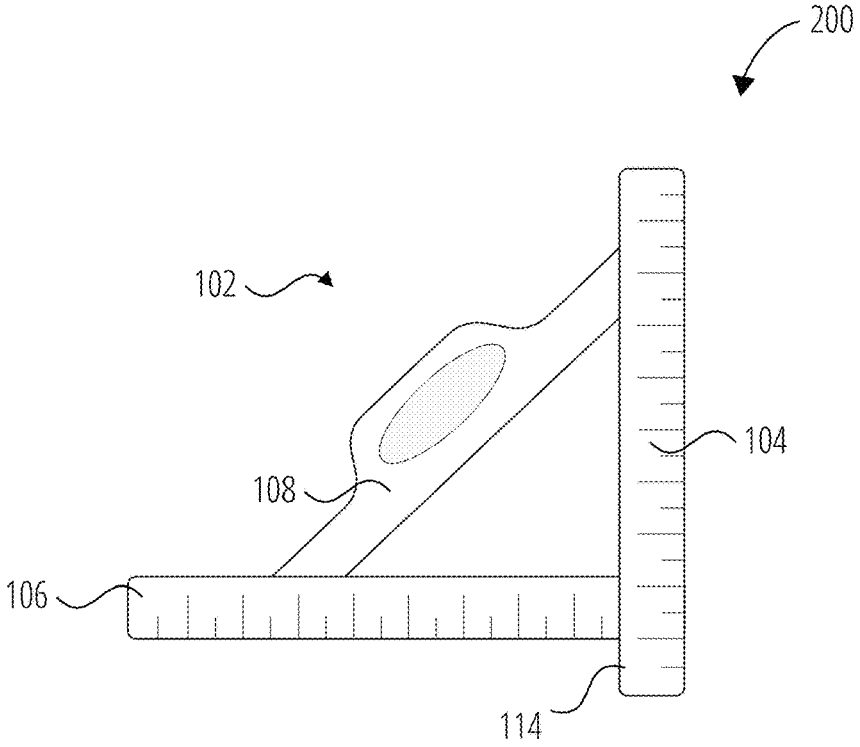

FIG. 2 illustrates a front view of a floor joist square, in accordance with one embodiment.

Figure 3:
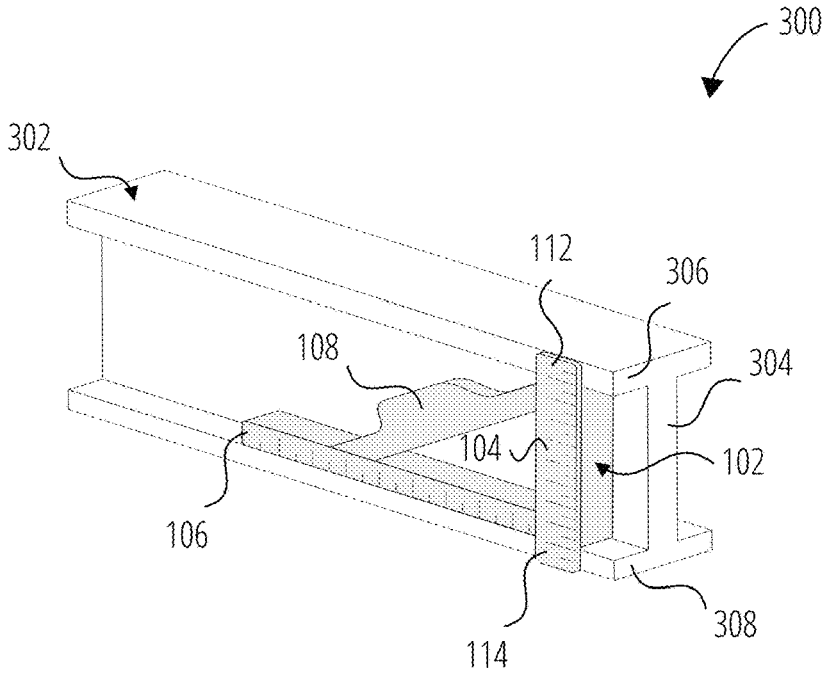

FIG. 3 illustrates an upright applied view of a floor joist square applied to an engineered I-shaped floor joist, in accordance with one embodiment.

Figure 4:
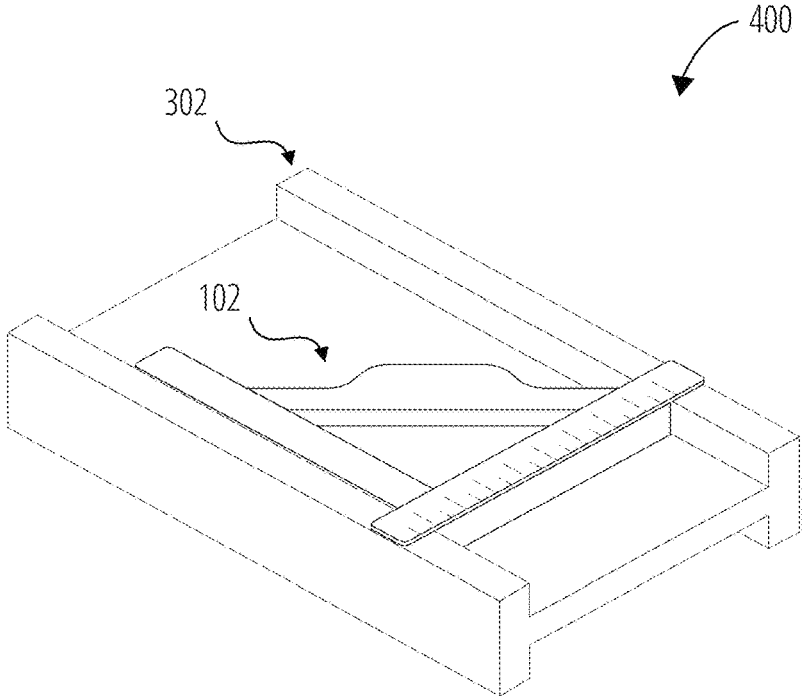

FIG. 4 illustrates a horizontal applied view of a floor joist square applied to an engineered I-shaped floor joist, in accordance with one embodiment.

Figure 5:
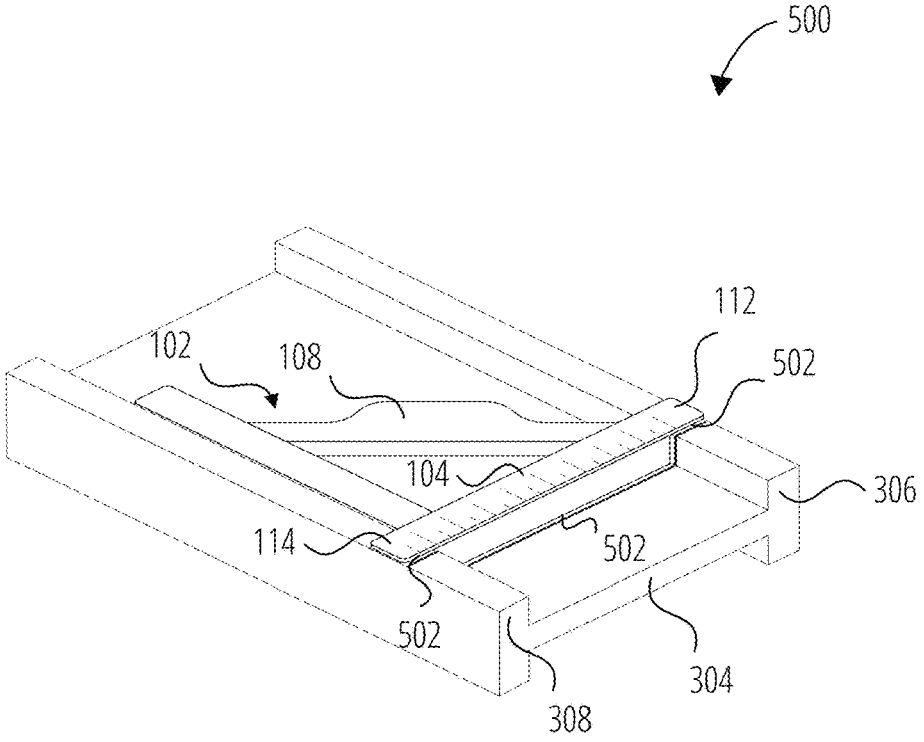

FIG. 5 illustrates a marking view of a floor joist square applied to an engineered I-shaped floor joist, in accordance with one embodiment.

Figure 6:
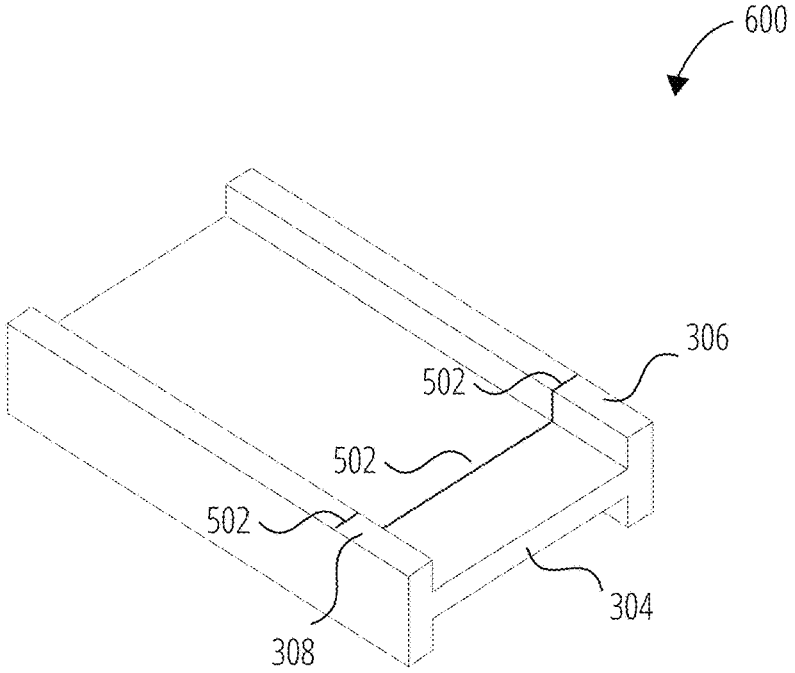

FIG. 6 illustrates a marked view of an engineered I-shaped floor joist, in accordance with one embodiment.

DETAILED DESCRIPTION

The details of one or more embodiments of the subject matter of this specification are set forth in the accompanying drawings and the description below. Other features, aspects, and advantages of the subject matter will become apparent from the description, the drawings, and the claims.

Like reference numbers and designations in the various drawings indicate like elements.

The disclosure proposes a floor joist square for facilitating marking a straight line along the face of an engineered I-shaped floor joist that overcomes disadvantages inherent in the existing marking tools, such as, but not limited to, marking for the cuts is required in multiple planes. The present invention provides a floor joist square that may be used with many different embodiments. As such, the general purpose of the present invention, which will be described subsequently in greater detail, is to provide a new and improved floor joist square for facilitating marking a straight line along the face of an engineered I-shaped floor joist, which provides the advantages and overcomes the aforementioned disadvantages.

FIG. 1 illustrates a perspective view 100 of a floor joist square 102, according to some embodiments. The floor joist square 102 is employed for facilitating marking a straight line along the face of an engineered I-shaped floor joist. The floor joist square 102 is shown comprising a blade member 104, a tongue member 106, and a handle 108.

The blade member 104 is flat and rectangular in shape, providing a guide for users to draw straight lines along the outer edge of the blade member 104. The blade member 104 comprises a substantially thin first lip 112 extending out from a first end of the blade member 104 and a substantially thin first lip 112 extending out from a second end of the blade member 104. In some embodiments, the blade member 104 further comprises a plurality of hatch marks 110 along a surface of the blade member 104 designating increments of spatial distance for measurement.

The tongue member 106 is flat and rectangular in shape, providing a guide for users to draw straight lines along the outer edge of the blade member 104. In some embodiments, the tongue member 106 further comprises a plurality of hatch marks 110 along a surface of the tongue member 106 designating increments of spatial distance for measurement.

The blade member 104 is perpendicularly affixed to an end of the tongue member 106 above the second lip 114. The blade member 104 may be perpendicularly affixed to an end of the tongue member 106 above the second lip 114 through methods such as, but not limited to, an applied adhesive, unitary construction of the two components, riveting, brazing, soldering, welding, or other common methods of joining or fusing known in the art.

A handle 108 is affixed to the blade member 104 and to the tongue member 106 such that the handle 108, the blade member 104, and the tongue member 106 form a triangular shape. The handle 108 may be affixed to the blade member 104 and to the tongue member 106 through methods such as but not limited to, an applied adhesive, unitary construction of the three components, riveting, brazing, soldering, welding, or other common methods of joining or fusing known in the art. The composition of the blade member 104, the tongue member 106, and the handle 108 may include but are not limited to, plastic, wood, metals, alloys, and other common materials known in the art.

FIG. 2 illustrates a front view 200 of a floor joist square 102, according to some embodiments. This view displays the triangular shape of the handle 108, the blade member 104, and the tongue member 106 of the floor joist square 102, as well as further emphasizes the extension of the second lip 114 below the intersection of the blade member 104 and the tongue member 106.

FIG. 3 illustrates an upright applied view 300 of a floor joist square 102 applied to an engineered I-shaped floor joist 302, according to some embodiments. This example depicts a typical engineered I-shaped floor joist 302, as is known in the art, in an upright position. The engineered I-shaped floor joist 302 is commonly used in construction and may vary in height and length. In some embodiments, the floor joist square 102 is fabricated via a 3D printer to accommodate the wide variety of heights and lengths of the engineered I-shaped floor joists 302. In some embodiments, the 3D printed floor joist square 102 is of unitary construction. In other embodiments, the blade member 104, the tongue member 106, and the handle 108 are 3D printed individually and then assembled into the floor joist square 102 as shown and described herein.

The engineered I-shaped floor joists 302 comprises a first flange 306 and a second flange 308 separated by a thin board referred to as a web 304. The first flange 306 and the second flange 308 are elevated above the plane of the web 304 while the first flange 306 and the second flange 308 lie along the same plane. In some embodiments, the thickness of the blade member 104, and the thickness of the tongue member 106 is equivalent to a recessed thickness of the web 304 from the top of a first flange 306 of an engineered I-shaped floor joist 302 and a second flange 308 of an engineered I-shaped floor joist 302.

FIG. 3 depicts a floor joist square 102 applied to an upright engineered I-shaped floor joist 302. The floor joist square 102 is shown inserted onto the engineered I-shaped floor joist 302 such that the tongue member 106 lies flat against a first flange 306, the blade member 104 lies flat against the web 304, the first lip 112 lies flat on top of the first flange 306 and the second lip 114 lies flat on top of a second flange 308. In some embodiments, a user may place a floor joist square 102 onto the engineered I-shaped floor joist 302 or remove the floor joist square 102 from the engineered I-shaped floor joist 302 via gripping the handle 108 and maneuvering the floor joist square 102.

FIG. 4 illustrates a horizontal applied view 400 of a floor joist square 102 applied to an engineered I-shaped floor joist 302, according to some embodiments.

FIG. 5 illustrates a marking view 500 of a floor joist square 102 applied to an engineered I-shaped floor joist 302, according to some embodiments. Once the length of the engineered I-shaped floor joist 302 has been determined by an installer a user may employ the floor joist square 102 to the engineered I-shaped floor joist 302 to mark for the cut. The floor joist square 102 is shown placed onto the engineered I-shaped floor joist 302 and the user has applied straight line markings 502 along the edge of the first lip 112, second lip 114, and blade member 104 in preparation for cutting the engineered I-shaped floor joist 302.

In some embodiments, the user may grip the handle 108 to hold the floor joist square 102 in place while marking 502 a second flange 308 along the edge of the second lip 114, marking 502 the web 304 along the edge of the blade member 104, and marking 502 the first flange 306 along the edge of the first lip 112 in one continuous motion.

FIG. 6 illustrates a marked view 600 of an engineered I-shaped floor joist 302, according to some embodiments. In this embodiment, the floor joist square 102 has been removed and a straight line marking 502 is present along the first flange 306, the second flange 308, and the web 304.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. As can be understood, the examples described above are intended to be exemplary only.

The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present invention.

The term "connected", "attached", "affixed" or "coupled to" may include both direct coupling (in which two elements that are coupled to each other contact each other) and indirect coupling (in which at least one additional element is located between the two elements).

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A floor joist square for facilitating marking a straight line along a face of an engineered I-shaped floor joist, the floor joist square comprising:

a blade member, the blade member being flat and rectangular in shape and comprising a substantially thin first lip extending out from a first end of said blade member and a substantially thin second lip extending out from a second end of said blade member;

a tongue member, the tongue member being flat and rectangular in shape and is perpendicularly affixed to said blade member at an end of said tongue member above said second lip; and a handle affixed to said blade member and said tongue member such that said handle, said blade member and said tongue member form a triangular shape, wherein a thickness of said blade member and a thickness of said tongue member is equivalent to a recessed thickness of a web from a top of a first flange of said engineered I-shaped floor joist and a second flange of said engineered I-shaped floor joist and wherein said floor joist square is fabricated via a 3D printer.

2. The floor joist square of claim 1, wherein said blade member further comprises a plurality of hatch marks along a surface of said blade member designating increments of spatial distance for measurement.

3. The floor joist square of claim 1, wherein said tongue member further comprises a plurality of hatch marks along a surface of said tongue member designating increments of spatial distance for measurement.

4. The floor joist square of claim 1, wherein said 3D printed floor joist square is of unitary construction.

5. A method of applying the floor joist square of claim 1, for marking said engineered I-shaped floor joist in preparation for cutting, the method comprising:

inserting the floor joist square onto said engineered I-shaped floor joist such that said tongue member lies flat against a second flange of said engineered I-shaped floor joist, said blade member lies flat against a web of said engineered I-shaped floor joist, said first lip lies flat on top of a first flange of said engineered I-shaped floor joist and said second lip lies flat on top of said second flange of said engineered I-shaped floor joist;

holding said floor joist square in place;

marking said second flange along an edge of said second lip, said web along an edge of said blade member and said first flange along an edge of said first lip in one continuous motion.

6. The method of claim 5, wherein said floor joist square is inserted onto said engineered I-shaped floor joist by gripping said handle and maneuvering said floor joist into place.

7. The method of claim 5, wherein said floor joist square is held in place by gripping said handle.

8. A floor joist square for facilitating marking a straight line along a face of an engineered I-shaped floor joist, the floor joist square comprising:

a blade member, the blade member being flat and rectangular in shape and comprising a substantially thin first lip extending out from a first end of said blade member and a substantially thin second lip extending out from a second end of said blade member;

a tongue member, the tongue member being flat and rectangular in shape and is perpendicularly affixed to said blade member at an end of said tongue member above said second lip; and a handle affixed to said blade member and said tongue member such that said handle, said blade member and said tongue member form a triangular shape, wherein said floor joist square is fabricated via a 3D printer and wherein said blade member, said tongue member and said handle are 3D printed individually and assembled into said floor joist square.

9. The floor joist square of claim 8, wherein said blade member further comprises a plurality of hatch marks along a surface of said blade member designating increments of spatial distance for measurement.

10. The floor joist square of claim 8, wherein said tongue member further comprises a plurality of hatch marks along a surface of said tongue member designating increments of spatial distance for measurement.

11. The floor joist square of claim 8, wherein said 3D printed floor joist square is of unitary construction.

* * * * *